US006176313B1

(12) United States Patent
Coenen et al.

(10) Patent No.: US 6,176,313 B1
(45) Date of Patent: Jan. 23, 2001

(54) METHOD AND TOOL FOR FRACTURING AN UNDERGROUND FORMATION

(75) Inventors: Josef Guillaume Christoffel Coenen; Cornelis Jan Kenter; Djurre Hans Zijsling, all of Rijswijk (NL)

(73) Assignee: Shell Oil Company, Houston, TX (US)

( * ) Notice: Under 35 U.S.C. 154(b), the term of this patent shall be extended for 0 days.

(21) Appl. No.: 09/343,804

(22) Filed: Jun. 30, 1999

(30) Foreign Application Priority Data

Jul. 1, 1998 (EP) ..... 98305212

(51) Int. Cl.[7] ..... E21B 43/26
(52) U.S. Cl. ..... 166/280; 166/55; 166/64
(58) Field of Search ..... 166/55, 55.2, 64, 166/72, 280

(56) References Cited

U.S. PATENT DOCUMENTS

| | | | |
|---|---|---|---|
| 2,687,179 | 8/1954 | Dismukes . | |
| 3,062,294 | 11/1962 | Huitt . | |
| 3,897,975 * | 8/1975 | Cobb et al. | 299/14 |
| 5,224,556 | 7/1993 | Wilson . | |
| 5,226,749 | 7/1993 | Perkins . | |
| 5,355,802 | 10/1994 | Petitjean . | |
| 5,511,615 | 4/1996 | Rhett . | |
| 5,576,485 | 11/1996 | Serato . | |
| 5,675,088 | 10/1997 | Serata . | |

FOREIGN PATENT DOCUMENTS 1602480 11/1970 (FR) .

OTHER PUBLICATIONS

Nishida: "Static Rock Breaker Using TiNi Shape Memory Alloy", Materials Science Forum, vol. 56–58, 1990, pp. 711–716, Nov. 15, 1999.
International Search Report of Nov. 15, 1999.

* cited by examiner

*Primary Examiner*—Roger Schoeppel

(57) ABSTRACT

A method for fracturing an underground formation surrounding an oil and/or gas well comprises positioning a fracturing tool in a selected orientation in the borehole and expanding the tool such that it exerts a circumferentially varying pressure against the borehole wall over a selected period of time thereby initiating in the surrounding formation one or more fractures which each intersect the borehole wall in a selected orientation and simultaneously injecting a proppant into the fracture(s).

15 Claims, 5 Drawing Sheets

METHOD AND TOOL FOR FRACTURING AN UNDERGROUND FORMATION

FIELD OF THE INVENTION

The invention relates to a method and tool for fracturing an underground formation surrounding a borehole for the production of hydrocarbon fluids, such as crude oil and/or natural gas.

BACKGROUND OF THE INVENTION

It is common practice to fracture an underground formation surrounding such a well by pumping a high pressure fluid into an area of the well which is hydraulically isolated from other parts of the well by a pair of isolation packers. The hydraulic pressure exerted to the formation surrounding that area will then initiate fractures in the formation surrounding the well. These fractures may serve to enhance inflow of oil and/or gas into the well, in which case a proppant and/or treatment fluid may be injected into the fractures to further stimulate the oil and/or gas production. Alternatively the fractures may serve to discharge drill cuttings and/or fluids into the formation.

Sometimes an inflatable sleeve is inflated in the borehole to limit loss of fracturing fluid into the fractures. The use of such a sleeve is known from U.S. Pat. Nos. 2,798,557, 2,848,052, 4,968,100, 4,657,306, 5,295,393 and 3,062,294.

Said U.S. Pat. No. 3,062,294 discloses that the expandable sleeve may be equipped with bit members which are mounted on pistons that are embedded in the sleeve and which are pushed radially into the formation to cleave the surrounding formation. The orientation of the cleaved fractures is essentially dictated by formation stresses so that the fractures are generally not parallel to the borehole.

U.S. Pat. No. 5,511,615 discloses a tool for measuring the in-situ borehole stress which tool comprises three short cylinder sections which are arranged in a vertical stack. Each cylinder section comprises two cylinder halves which are pressed against the formation to initiate a fracture generally in a plane that divides the cylinder halves. The cylinder sections are stacked in a vertically offset manner such that the planes that divide the cylinder halves of adjacent sections intersect each other at about 60 degrees. In this manner an accurate determination of the size and orientation of formation stresses can be made.

U.S. Pat. No. 's 5,678,088 and 5,576,488 disclose other mechanical fracturing tools for measuring formation stresses by temporarily creating fractures in a selected orientation into the formation, which fractures are allowed to close again after the measurement has been made.

U.S. Pat. No. 2,687,179 discloses a mechanical formation fracturing tool which comprises a pair of semitubular expansion members which are pressed in diametrically opposite directions against the borehole wall by hammering a wedge between the expansion members. The known tool is able to obtain at least partial control of the direction of fracturing but has the disadvantage that the impacts generated by the hammering action may damage the borehole wall and crush the surrounding formation in the vicinity of wellbore which reduces the control of the fracturing process. French patent specification 1602480 discloses a fracturing tool where a pair of semi-tubular elements are expanded by hydraulic pressure.

It is an object of the present invention to provide a tool and method for fracturing an underground formation where the generated fractures can be held open over a sufficient period of time to allow the placement of a proppant and a treatment or other fluid in the fracture, while causing less interruption of other activities in the borehole than would occur with the known fracturing techniques.

SUMMARY OF THE INVENTION

The method according to the invention comprises:

moving into the borehole a fracturing tool which is adapted to exert a pressure which varies in a circumferential direction against the borehole wall;

positioning the fracturing tool at a selected downhole location and circumferential orientation in the borehole;

expanding the fracturing tool such that the tool exerts a circumferentially varying pressure against the borehole wall during a selected period of time, thereby initiating in the surrounding formation at least one fracture which intersects the borehole wall at a selected orientation; and inserting a proppant into at least one fracture during at least part of said period of time.

Suitably, the period of time during which the tool exerts a circumferentially varying pressure against the borehole wall is at least 5 seconds.

DETAILED DESCRIPTION

Figure 1:
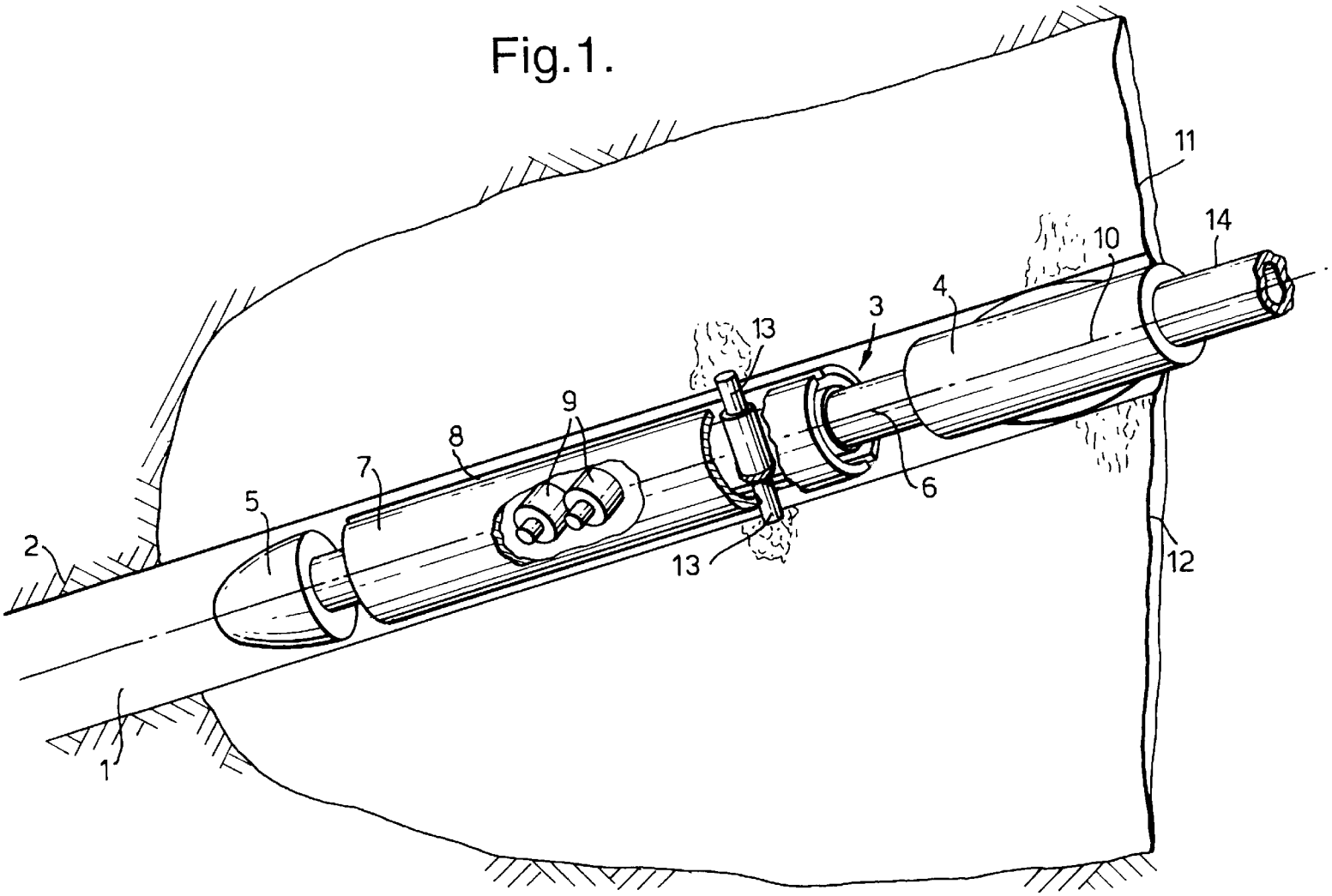
FIG. 1 is a schematic three-dimensional, partially exploded, view of a fracturing tool according to the invention inside an underground borehole.

An advantage of the method according to the invention is that it allows a simultaneous creation of well defined fractures in a well defined orientation and pattern around the well and placement of a proppant into the opened fractures while causing a minimal interruption of other well activities. The fracturing method can, for example, be carried out while drilling or oil and/or gas production operations take place simultaneously.

Preferably, the tool is equipped with a series of formation crushing pins which penetrate into, and are retracted from, the initiated fracture when the tool is in the expanded position thereof, thereby pushing crushed formation debris into each fracture, which debris forms the proppant which keeps each fracture at least partly open after retraction of the fracturing tool.

The use of crushing pins facilitates an easy placement of proppant instantly when the fracture is initiated by the expanded tool without requiring injection of proppant from the surface, which results in a significant reduction of time required for placement of the proppant and elimination of the interruption to other well activities caused by the conventional proppant placement procedures where proppant is injected from the surface.

If it is required to initiate fractures in diametrically opposite, triangular or orthogonal directions from the borehole then a fracturing tool may be applied which comprises at least two substantially longitudinally cut and complementary pipe segments, which are co-axial to a central axis of the tool and which are, when the tool is expanded, pushed radially from the central axis and against the borehole wall by means of a hydraulic, mechanical, or heat activated memory metal actuator mechanism.

It is observed that it is known from Japanese patent application No. 4141562 and from the paper "static rock breaker using TiNi shape memory alloy" presented at the Materials Science forum, Vols. 56–58 (1990) pp. 711–716 to expand a number of semi-cylindrical expansion elements in a borehole traversing a rock formation by heating a shape memory alloy. The known static rock breaker serves to replace known blasting equipment, is only 6 cm long and 4 cm wide, and may comprise two opposite semi-cylindrical or three triangularly oriented or four orthogonally oriented expansion elements. It is observed that in the method according to the invention a fracturing tool comprising a similar pattern of 2, 3, 4 or more expansion elements may be used, depending on the orientation and pattern of fractures that is required.

If it is required to support, protect and stabilise the borehole wall during and after the fracturing process then the fracturing tool may be positioned within an expandable slotted tubular in a well inflow zone within a hydrocarbon fluid bearing formation, which tubular is expanded against the formation as a result of the expansion of the fracturing tool and which tubular is perforated by the formation crushing pins when the pins penetrate into the fractures.

A suitable expandable slotted tubular for use in the method is a tubular with staggered longitudinal slots which deform into a prismatic shape as a result of the expansion process. Such an expandable slotted tubular is disclosed in European specification patent No. 0643795.

In certain well stimulation operations it is required to initiate a pair of elongate diametrically opposite fractures in a desired orientation around a horizontal or inclined well inflow zone, which may be hundreds or thousands of meters long.

In such case in the method according to the invention a fracturing tool may be used which comprises two complementary pipe halves, which are each at least 5 m long and are radially movable in opposite directions relative to the central axis of the tool and the crushing pins extend through openings between the pipe halves and are expandable in radial directions relative to the central axis of the tool which directions are substantially orthogonal to the directions in which the pipe halves are movable and wherein the fracturing tool is oriented and expanded while the rock crushing pins are actuated to insert crushed formation particles into the opened fracture, and subsequently moved over a length which substantially corresponds to the length of the pipe halves and oriented and expanded while the rock crushing pins are actuated to insert crushed formation particles into the opened fracture, which sequence of steps is repeated until a substantial part of the formation around the well inflow area has been fractured such that elongate fractures are created in the formation over a substantial length of the well inflow zone which fractures intersect the borehole wall at a predetermined orientation.

Accordingly the fracturing method according to the invention is suitable for use as part of a method for enhancing fluid production from an oil and/or gas production well, which method can be carried out at any time of the life cycle of the well and with minimal or no interruption of the oil and/or gas production operations.

Alternatively the fracturing method according to the invention is used to dispose drill cuttings in a formation surrounding an underground borehole which is being drilled towards an oil and/or gas bearing formation In that case it is preferred that the fracturing tool forms part of a drilling assembly and a drilling fluid comprising drill cuttings is pumped from the drill bit into the fractures surrounding the tool and the tool is equipped with a screen which allows drilling fluid to be pumped back towards the drill bit but which prevents drill cuttings of a size larger than the sieve openings of the screen to re-enter the borehole.

The invention furthermore relates to a tool for fracturing an underground formation, which tool comprises:

- a tool body having a central axis, which tool body is rotatably connected to an orienting sub such that the tool body is rotatable about the central axis relative to the orienting sub;
- an orienting mechanism for orienting the tool body in a predetermined angular position relative to the central axis;
- a number of tubular or semi-tubular expansion elements mounted on the tool body such that each expansion element is movable in a radial direction relative to the central axis of the tool body;
- an expansion mechanism for pressing each expansion element during a selected period of time against the formation in such a manner that in use the expansion elements exert a circumferentially varying pressure against the borehole wall; and
- means for inserting a proppant into at least one fracture during at least part of said period of time.

In a suitable embodiment the tool comprises a pair of semi-tubular expansion elements which are radially movable in opposite directions relative to the central axis of the tool body and proppant injection means which are formed by a series of rock crushing pins which are radially movable relative to the central axis in directions which are substantially orthogonal to said opposite directions.

The fracturing method and tool according to the invention will be described in more detail and by way of example with reference to the accompanying drawings.

FIG. 1 illustrates an inclined, nearly horizontal, borehole 1, which traverses an underground oil and/or gas bearing formation 2.

A fracturing tool 3 according to the invention is located inside the borehole 1. The tool 3 comprises an orienting sub 4, a bull nose 5 and a tool body 6 which is equipped with two semi-cylindrical expansion elements 7 and 8.

A series of hydraulic piston-cylinder assemblies 9, of which two are shown, is arranged between the tool body 6 and the expansion elements 7 and 8. By pumping a high pressure fluid into the hydraulic piston-cylinder assemblies 9 the expansion elements 7 and 8 are pressed at a predetermined pressure against the wall of the borehole 1. Before expansion of the elements 7 and 8 the tool body 6 is rotated about a central axis 10 of the tool by a rotation mechanism (not shown) in the orienting-sub 4 until the tool body 6 is oriented such that the plane of separation between the elements 7 and 8 has a predetermined orientation, which plane is in the example shown substantially vertical and coincides with the plane of the drawing.

By expanding the elements 7 and 8 in the selected position shown a pair of substantially vertically oriented fractures 11 and 12 are formed in the formation 2 above and underneath the borehole 1 once the lateral pressure exerted by the elements 7 and 8 against the borehole wall exceeds a certain value.

The elements 7 and 8 are pressed against the borehole wall such that they open up the fractures during a prolonged period of time which preferably is at least five seconds. During that period of time a series of rock crushing pins 13 of which two are shown, are pushed into the opened fractures 11 and 12 so as to push crushed rock or other formation particles into the fractures which particles form a proppant which keeps the fractures 11 and 12 at least partly open after recontraction of the crushing pins 13 and the expansion elements 7 and 8 at the end of the fracturing procedure.

The fracturing tool 3 is connected to an umbilical 14, which is formed by a coiled tubing, drill pipe or an electrical cable and which pulls or pushes the tool 3 through the borehole 1 after the above-described fracturing procedure to create a pair of vertical fractures adjacent to a next section of the borehole 1, which procedure is repeated until at least a substantial part of the well inflow zone is fractured and a pair of elongate fractures 11 and 12 are created below and above that zone.

In the example shown the expansion elements 7 and 8 each have a length of at least 5 meters and the horizontal well inflow zone has a length of several kilometers so that the cycle of moving the tool 3 over a distance of about 5 meters and then orienting the tool body 4, and expanding and retracting the expansion elements 7 and 8 and crushing pins 13 is repeated many hundreds or even thousands of times. Therefore it is important that the fracturing tool according to the invention is able to quickly initiate the fractures in a well defined orientation and to quickly insert crushed rock and formation particles into the initiated fractures so that an efficient fracturing process is provided.

Figure 2:
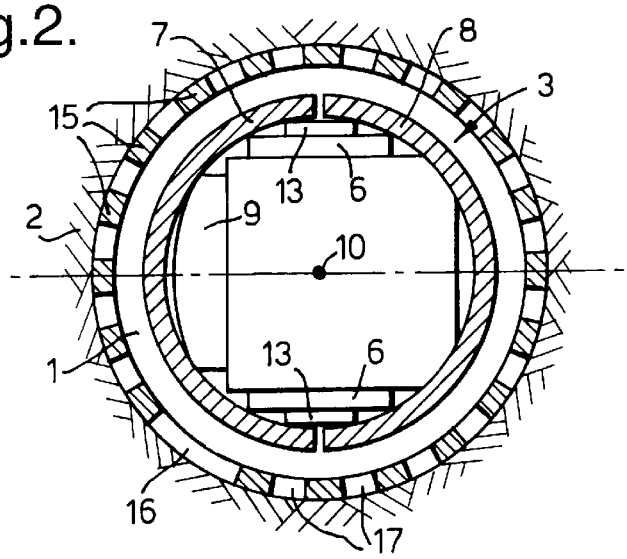
FIG. 2 is a schematic transversal view of the tool of FIG. 1 in contracted position within a borehole in which an expandable slotted tube is arranged.

FIG. 2 is a schematic cross-sectional view of the fracturing tool 3 of FIG. 1 in a contracted position in a borehole 1 in which an expandable slotted tubular 15 has been expanded against the borehole wall 16.

The tubular 15 has been expanded such that its staggered initially longitudinal slots 17 open up to a prismatic configuration.

In the contracted position shown in FIG. 2 the elements 7 and 8 form a substantially tubular shell, which encapsulates the tool body 6, the piston- and cylinder-assemblies 9 and the retracted rock crushing pins 13.

Figure 3:
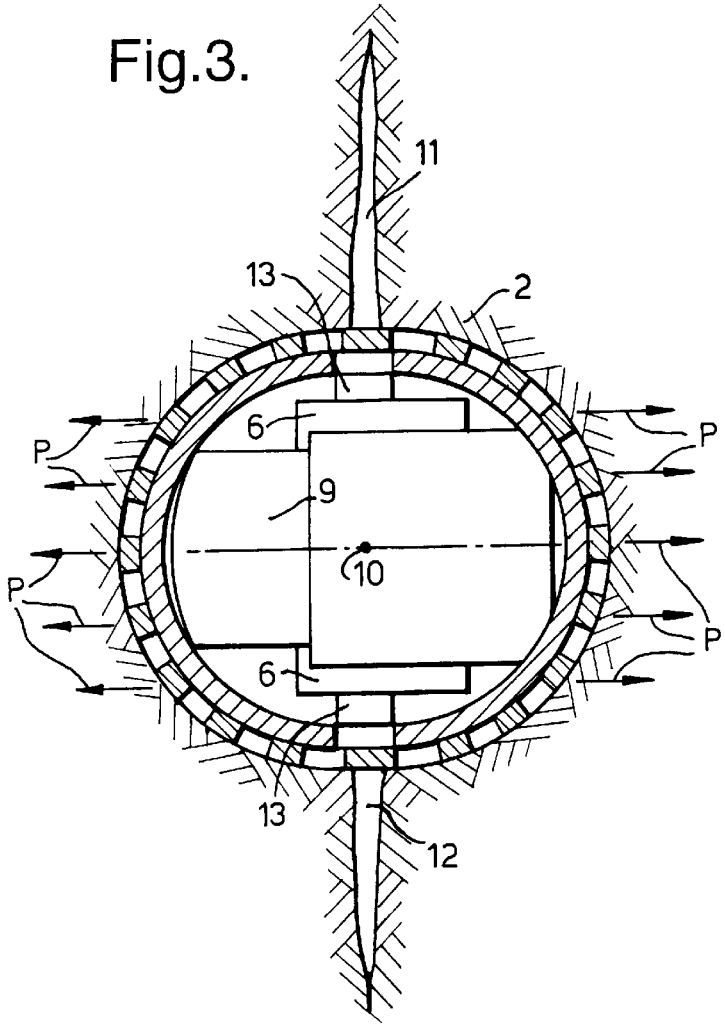
FIG. 3 shows the tool of FIG. 2 in the expanded position thereof.

FIG. 3 shows the tool 3 of FIGS. 1 and 2 in the expanded position, wherein the tubular semi-cylindrical expansion elements 7 and 8 are pressed by the hydraulic piston and cylinder assemblies 9 against the slotted tubular 15, thereby further expanding the tubular 15 into an oval configuration and causing the tubular 15 to exert a circumferentially varying pressure p to the borehole wall, which pressure has a generally horizontal orientation and initiates the generation of fractures 11 and 12 having a substantially vertical orientation in the surrounding formation 2.

Figure 4:
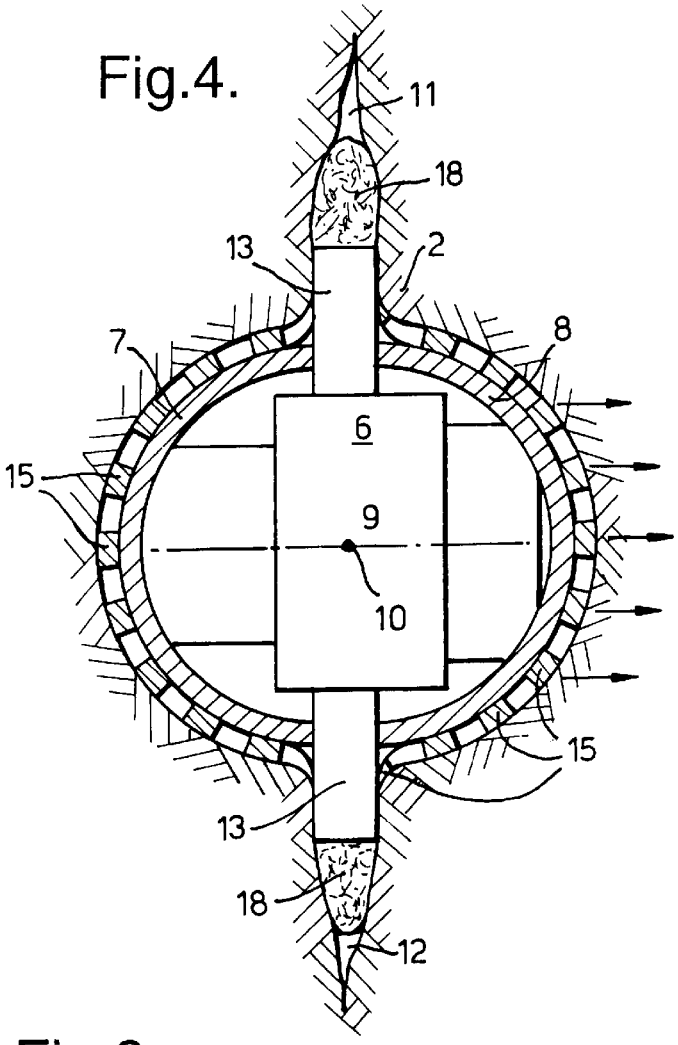
FIG. 4 shows the tool of FIGS. 2 and 3 wherein rock crushing pins are pushed through the slotted tubing into the opened fractures to generate proppant which keeps the fractures at least partially open after retrieval of the fracturing tool.

FIG. 4 shows the tool 3 wherein the expansion elements 7 and 8 are maintained in their expanded position such that they keep the fractures 11 and 12 open while the rock crushing pins 13 are pushed into the opened fractures 11 and 12 thereby releasing crushed rock particles 18 from the formation 2 and pushing the particles 18 into the fractures 11 and 12 to serve as a proppant 18 which keeps the fractures 11 and 12 at least partly open after contraction of the pins 13 and the expansion elements 7 and 8 and the retrieval of the tool 3 from the borehole.

FIG. 4 also shows that the rock crushing pins 13 also pierce through and perforate the slotted tubular 15.

Figure 6:
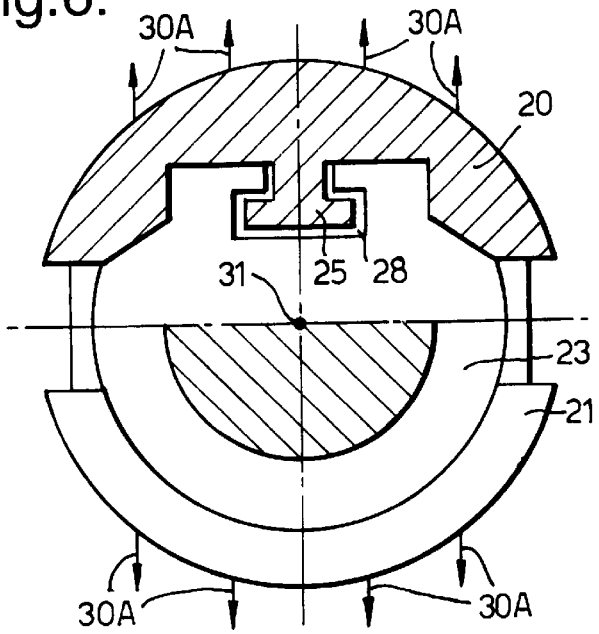
FIG. 6 shows a cross-sectional view of the tool of FIG. 5, taken along line A—A and seen in the direction of the arrows.
Figure 5:
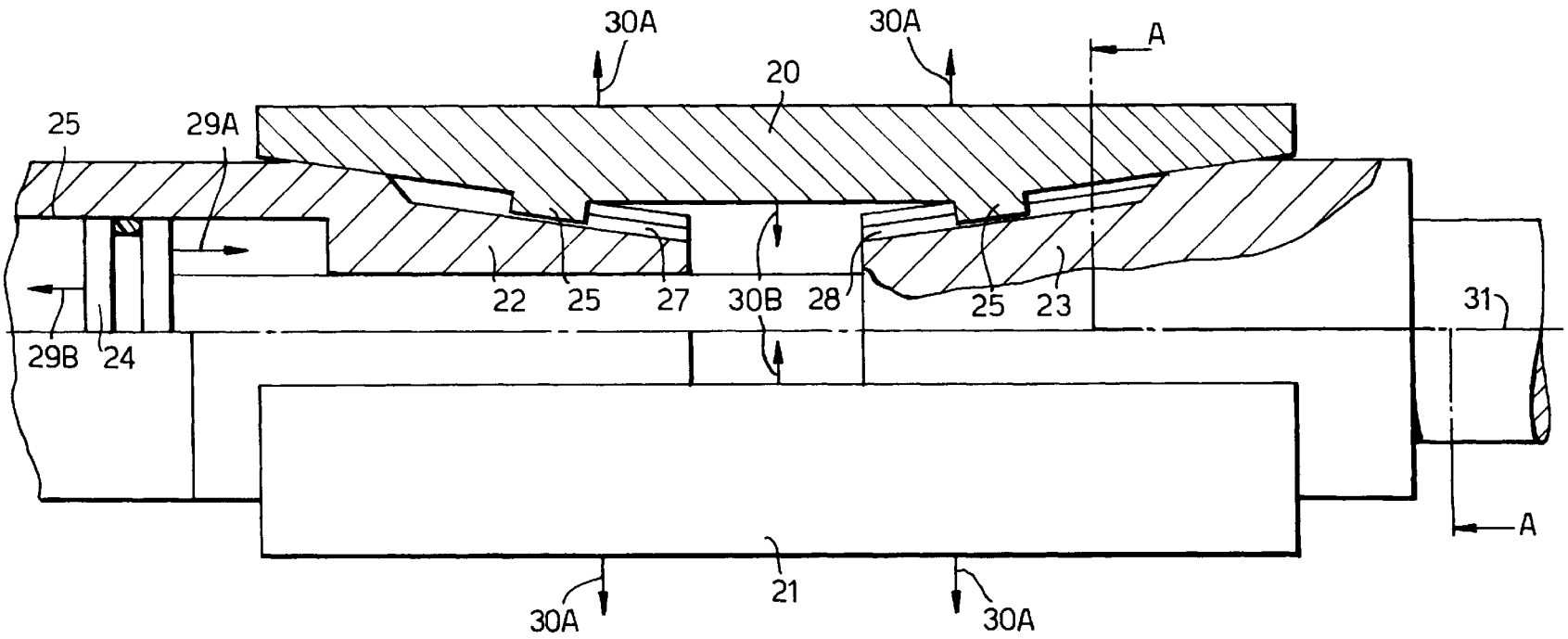
FIG. 5 shows a fracturing tool comprising a wedgeshaped expansion mechanism, the upper part of the tool being displayed in a longitudinal sectional view and the lower part in a side view.

FIG. 5 shows an alternative embodiment of the tool according to the invention wherein the tool comprises a pair of semi-cylindrical expansion elements 20 and 21 which are slidably mounted on two tapering sections of a carrier body which comprises two parts 22 and 23 which can be moved axially relative to each other by means of a piston and cylinder assembly 24, 25. One part 22 of the tool body forms the cylinder 25 and the other part 23 of the tool body is connected to the piston 24. The expansion elements 20 and 21 comprise dove tails 25, which are also illustrated in FIG. 6 and which can translate through a pair of guide channels 27 and 28 which are formed within the tapering sections of the carrier body. Thus, by hydraulically pushing the piston 24 into the cylinder 25 in the direction of arrow 29A the expansion elements 20 and 21 are pushed radially away from a central axis 31 of the tool in diametrically opposite directions which are illustrated by arrows 30A, whereas by hydraulically pushing the piston 24 out of the cylinder 25 in the direction of arrow 29B the expansion elements 20 and 21 are retracted towards the central axis 31 as illustrated by arrows 30B.

The procedure for orienting the tool shown in FIGS. 5 and 6 and fracturing of the surrounding formation is similar to the procedures described with reference to FIGS. 1–4.

Figure 7:
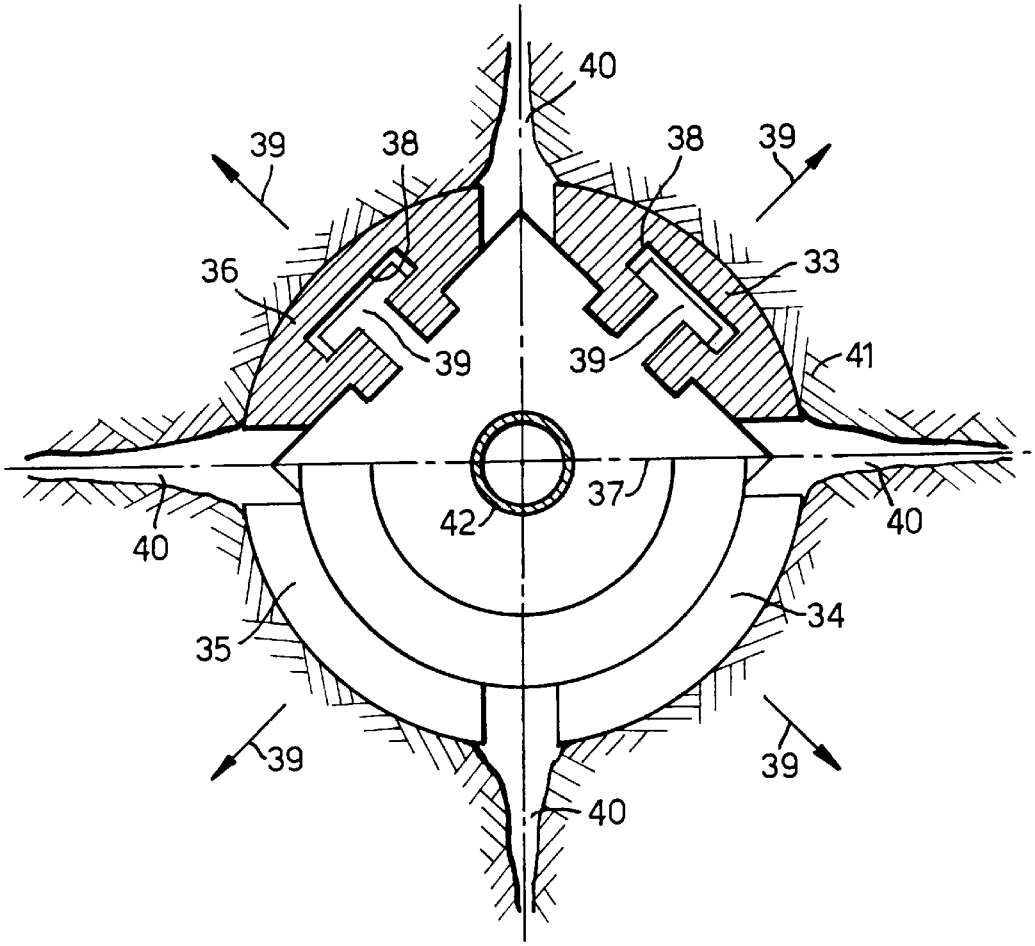
FIG. 7 shows a schematic partially cross-sectional view of a fracturing tool which comprises four expansion segments.

FIG. 7 shows yet another alternative embodiment of the fracturing tool according to the invention where the tool comprises four semi-cylindrical expansion elements 33, 34, 35 and 36, which are mounted on two tapering sections of a two-part carrier body 37 which is, apart from the presence of four guide channels 38 on the tapering sections, similar to the carrier body of the tool shown in FIGS. 5 and 6.

Thus, by pushing the tapering sections of the two-part carrier body 37 away from each other, the dove tails 39 of the elements 33–36 will slide through the guide channels 38 such that the expansion elements 33–36 move in four mutually orthogonal directions radially away from the carrier body 37, which directions are illustrated by arrows 39.

The radial expansion of the elements in said orthogonal directions 39 will initiate the formation of four mutually orthogonal fractures 40 in the formation 41 surrounding the fracturing tool. The tool shown in FIG. 7 can be oriented and cyclically expanded and moved in the same manner as described for the tool shown in FIG. 1, in order to generate a set of four elongate fractures in mutually orthogonal directions in the formation 41.

The tool shown in FIG. 7 is particularly useful for generating fractures around a drilling assembly wherein a large volume of fractures 40 can be created around the borehole in which fractures drill cuttings are discharged. In that case it is preferred that the fracturing tool slidably surrounds the drill string 42 of a drilling assembly and the fracturing tool is stepwise moved in downward direction through the borehole which is being drilled, while drilling progresses. By circulating drilling fluid which is loaded with drill cuttings through the fractures 40 and preventing the drill cuttings to re-enter the borehole by a sandscreen (not shown) the fractures 40 will gradually fill up with drill cuttings, which cuttings subsequently serve as a proppant which keeps the fractures 40 at least partly open after retraction and retrieval of the fracturing tool.

We claim:

1. A method for fracturing an underground formation surrounding a borehole for the production of hydrocarbon fluids, the method comprising:

moving into the borehole a fracturing tool which is adapted to exert a pressure which varies in a circumferential direction against the borehole wall;

positioning the fracturing tool at a selected downhole location and circumferential orientation in the borehole;

expanding the fracturing tool such that the tool exerts a circumferentially varying pressure against the borehole wall during a selected period of time, thereby initiating in the surrounding formation at least one fracture which intersects the borehole wall at a selected orientation; and inserting a proppant into at least one fracture during at least part of said period of time.

2. The method of claim 1, wherein period of time during which the tool exerts a circumferentially varying pressure against the borehole wall is at least 5 seconds.

3. The method of claim 2, wherein the fracturing tool is equipped with a series of formation crushing pins which penetrate into, and are retracted from, the initiated fracture when the tool is in the expanded position thereof, thereby pushing crushed formation debris into each fracture, which debris forms the proppant which keeps each fracture at least partly open after retraction of the fracturing tool.

4. The method of claim 2, wherein the fracturing tool comprises at least two substantially longitudinally cut and complementary pipe segments, which are co-axial to a central axis of the tool and which are, when the tool is expanded, pushed radially from the central axis and against the borehole wall by means of a hydraulic, mechanical, or heat activated memory metal actuator mechanism.

5. The method of claim 3, wherein the fracturing tool is positioned within an expandable slotted tubular in a well inflow zone within a hydrocarbon fluid bearing formation, which tubular is expanded against the formation as a result of the expansion of the fracturing tool and which tubular is perforated by the formation crushing pins when the pins penetrate into the fractures.

6. The method of claim 5, wherein the fracturing tool comprises two complementary pipe halves, which are each at least 5 m long and are radially movable in opposite directions relative to the central axis of the tool and the crushing pins extend through openings between the pipe halves and are expandable in radial directions relative to the central axis of the tool which directions are substantially orthogonal to the directions in which the pipe halves are movable and wherein the fracturing tool is oriented and expanded while the rock crushing pins are actuated to insert crushed formation particles into the opened fracture, and subsequently moved over a length which substantially corresponds to the length of the pipe halves and oriented and expanded while the rock crushing pins are actuated to insert crushed formation particles into the opened fracture, which sequence of steps is repeated until a substantial part of the formation around the well inflow area has been fractured such that elongate fractures are created in the formation over a substantial length of the well inflow zone which fractures intersect the borehole wall at a predetermined orientation.

7. The method of claim 4, wherein the fracturing tool is positioned within an expandable slotted tubular in a well inflow zone within a hydrocarbon fluid bearing formation, which tubular is expanded against the formation as a result of the expansion of the fracturing tool and which tubular is perforated by the formation crushing pins when the pins penetrate into the fractures.

8. The method of claim 7, wherein the fracturing tool comprises two complementary pipe halves, which are each at least 5 m long and are radially movable in opposite directions relative to the central axis of the tool and the crushing pins extend through openings between the pipe halves and are expandable in radial directions relative to the central axis of the tool which directions are substantially orthogonal to the directions in which the pipe halves are movable and wherein the fracturing tool is oriented and expanded while the rock crushing pins are actuated to insert crushed formation particles into the opened fracture, and subsequently moved over a length which substantially corresponds to the length of the pipe halves and oriented and expanded while the rock crushing pins are actuated to insert crushed formation particles into the opened fracture, which sequence of steps is repeated until a substantial part of the formation around the well inflow area has been fractured such that elongate fractures are created in the formation over a substantial length of the well inflow zone which fractures intersect the borehole wall at a predetermined orientation.

9. A method for enhancing fluid production from a hydrocarbon fluid production well, the method comprising inserting a slotted tubular into the inflow zone of the well and sequentially expanding and perforating adjacent sections of the slotted tubular by moving and expanding a fracturing tool within the slotted tubular in accordance with the method according to claim 6.

10. A method for disposing drill cuttings in a formation surrounding a borehole for the production of hydrocarbon fluids, the method comprising expanding a fracturing tool within the borehole in accordance with the method according to claim 4 and inserting drill cutting as proppant into the fractures adjacent to the expanded tool.

11. The method of claim 10, wherein the fracturing tool forms part of a drilling assembly and a drilling fluid comprising drill cuttings is pumped from the drill bit into the fractures surrounding the tool and the tool is equipped with a screen which allows drilling fluid to be pumped back towards the drill bit but which prevents drill cuttings of a size larger than the sieve openings of the screen to re-enter the borehole.

12. A tool for fracturing an underground formation surrounding a borehole for the production of hydrocarbon fluids, the tool comprising:

a tool body having a central axis, which tool body is rotatably connected to an orienting sub such that the tool body is rotatable about the central axis relative to the orienting sub;

an orienting mechanism for orienting the tool body in a predetermined angular position relative to the central axis;

a number of tubular or semi-tubular expansion elements mounted on the tool body such that each expansion element is movable in a radial direction relative to the central axis of the tool body; and an expansion mechanism for pressing each expansion element during a selected period of time against the formation in such a manner that in use the expansion elements exert a circumferentially varying pressure against the borehole wall; and means for inserting a proppant into at least one fracture during at least part of said period of time.

13. The tool of claim 12, wherein the tool comprises a pair of semi-tubular expansion elements which are radially movable in opposite directions relative to the central axis of the tool body and the proppant inserting means comprise a series of rock crushing pins which are radially movable relative to the central axis in directions which are substantially orthogonal to said opposite directions.

14. The tool of claim 12, wherein the proppant injection means comprise a proppant slurry injection system.

15. The tool of claim 14, wherein the tool forms part of a drilling assembly and surrounds a section of a drill string which is located at a selected distance from a drill bit such that the expansion elements are expandable and fracture the surrounding formation while drilling operations take place and drill cuttings are injectable as a proppant into the fractured formation.

* * * * *